US012066231B2

(12) United States Patent
Roullet, Sr. et al.

(10) Patent No.: US 12,066,231 B2
(45) Date of Patent: Aug. 20, 2024

(54) CONTROL SYSTEM FOR A VAPOR COMPRESSION SYSTEM

(71) Applicants: Johnson Controls Tyco IP Holdings LLP, Milwaukee, WI (US); Johnson Controls Industries SAS, Carquefou (FR)

(72) Inventors: Guillaume Julien Roullet, Sr., Nantes (FR); Alain Le Bras, Carquefou (FR); Damien Jean Daniel Arnou, Le Séguinière (FR); Paul Eric Le Sausse, Nantes (FR); Laurent Claude Eric Thibaud, Mouzillon (FR); Francois Charles Andre Clunet, La Chapelle-sur-Erdre (FR)

(73) Assignees: Tyco Fire & Security GmbH, Schaffhausen (CH); Johnson Controls Industries SAS, Carquefou (FR)

( * ) Notice: Subject to any disclaimer, the term of this patent is extended or adjusted under 35 U.S.C. 154(b) by 351 days.

(21) Appl. No.: 17/608,448

(22) PCT Filed: May 3, 2019

(86) PCT No.: PCT/EP2019/061376
§ 371 (c)(1),
(2) Date: Nov. 2, 2021

(87) PCT Pub. No.: WO2020/224742
PCT Pub. Date: Nov. 12, 2020

(65) Prior Publication Data
US 2022/0196310 A1 Jun. 23, 2022

(51) Int. Cl.
*F25B 49/02* (2006.01)
*F25B 31/00* (2006.01)

(52) U.S. Cl.
CPC ..... *F25B 49/022* (2013.01); *F25B 31/004* (2013.01); *F25B 2400/08* (2013.01);
(Continued)

(58) Field of Classification Search
CPC .. F25B 49/022; F25B 31/004; F25B 2400/08; F25B 2500/16; F25B 2500/27;
(Continued)

(56) References Cited

U.S. PATENT DOCUMENTS

2002/0129612 A1* 9/2002 Saikusa ..... F25B 49/025 62/84
2015/0185197 A1* 7/2015 Liang ..... G01N 11/00 62/468
(Continued)

FOREIGN PATENT DOCUMENTS

JP 03105160 A * 5/1991 ..... F25B 31/006

OTHER PUBLICATIONS

JP-03105160-A Translation (Year: 1991).*
PCT International Search Report for PCT Application No. PCT/EP2019/061376, mailed Apr. 6, 2020, 5 pgs.

*Primary Examiner* — David J Teitelbaum
(74) *Attorney, Agent, or Firm* — Fletcher Yoder, P.C.

(57) ABSTRACT

A vapor compression system includes a compressor configured to circulate a refrigerant through a refrigerant loop, a sump configured to receive a mixture of lubricant and the refrigerant from the compressor, and a controller having a memory and a processor. The processor is configured to receive a first signal indicative of a temperature of the mixture within the sump, receive a second signal indicative of a pressure of the mixture within the sump, determine a relative amount of the refrigerant in the mixture based on the first signal and the second signal, and output a control signal
(Continued)

in response to the relative amount of the refrigerant in the mixture exceeding a threshold value.

18 Claims, 7 Drawing Sheets

(52) U.S. Cl.
CPC ..... *F25B 2500/16* (2013.01); *F25B 2500/27* (2013.01); *F25B 2600/0251* (2013.01); *F25B 2600/13* (2013.01); *F25B 2700/1932* (2013.01); *F25B 2700/2105* (2013.01)

(58) Field of Classification Search
CPC ..... F25B 2600/0251; F25B 2600/13; F25B 2700/1932; F25B 2700/2105
See application file for complete search history.

(56) References Cited

U.S. PATENT DOCUMENTS

| | | | | |
|---|---|---|---|---|
| 2016/0003510 | A1* | 1/2016 | De Larminat | F25B 43/02 62/470 |
| 2016/0123634 | A1* | 5/2016 | Smith | F25B 31/004 165/287 |
| 2018/0320672 | A1 | 11/2018 | Munroe | |
| 2019/0032982 | A1* | 1/2019 | Schoonen | F25B 49/027 |
| 2019/0128580 | A1 | 5/2019 | Suemitsu et al. | |

* cited by examiner

CONTROL SYSTEM FOR A VAPOR COMPRESSION SYSTEM

CROSS-REFERENCE TO RELATED APPLICATIONS

This application is a U.S. National Stage Application of PCT Application No. PCT/EP2019/061376, entitled "CONTROL SYSTEM FOR A VAPOR COMPRESSION SYSTEM," filed May 3, 2019, which is hereby incorporated by reference in its entirety for all purposes.

BACKGROUND

This application relates generally to vapor compression systems, such as chillers, and more specifically to a control system for vapor compression systems.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Refrigeration systems are used in a variety of settings and for many purposes. For example, refrigeration systems may include a vapor compression refrigeration cycle, which may have a condenser, an evaporator, a compressor, a sump, and/or an expansion device. Some systems include a lubricant (e.g., oil) that circulates through the compressor and the sump to provide lubrication for the compressor. As the lubricant circulates, refrigerant within the compressor may mix with the lubricant. The mixture may cause reduced performance of the compressor (e.g., the mixture may not properly lubricate certain components of the compressor and/or may produce foaming in certain components due to pressure reduction or temperature increase) and the mechanical cooling system generally. Additionally, the lubricant circulating back to the compressor from the sump may include characteristics that may further reduce a performance of the compressor and/or the mechanical cooling system.

SUMMARY

In an embodiment of the present disclosure, a vapor compression system includes a compressor configured to circulate a refrigerant through a refrigerant loop, a sump configured to receive a mixture of lubricant and the refrigerant from the compressor, and a controller having a memory and a processor. The processor is configured to receive a first signal indicative of a temperature of the mixture within the sump, receive a second signal indicative of a pressure of the mixture within the sump, determine a relative amount of the refrigerant in the mixture based on the first signal and the second signal, and output a control signal in response to the relative amount of the refrigerant in the mixture exceeding a threshold value.

In an embodiment of the present disclosure, a vapor compression system includes a compressor configured to circulate a refrigerant through a refrigerant loop and a lubrication circuit having a cooler configured to receive a mixture of a lubricant and the refrigerant from a sump. The cooler is configured to absorb thermal energy from the mixture received from the sump and includes an inlet fluidly coupled to the sump and an outlet fluidly coupled to the compressor. The vapor compression system also includes a controller having a memory and a processor. The processor is configured to receive a signal indicative of a temperature of the mixture at the outlet of the cooler, determine a viscosity value of the mixture based on the signal, and output a control signal in response to the viscosity value exceeding a threshold range.

In an embodiment of the present disclosure, a vapor compression system includes a compressor configured to circulate a refrigerant through a refrigerant loop, a sump configured to receive a mixture of lubricant and the refrigerant from the compressor, and a cooler configured to receive the mixture from the sump. The cooler is configured to absorb thermal energy from the mixture and includes an inlet fluidly coupled to the sump and an outlet fluidly coupled to the compressor. The vapor compression system also includes a controller having a memory and a processor. The processor is configured to receive a first signal indicative of a temperature of the mixture within the sump, receive a second signal indicative of a pressure of the mixture within the sump, receive a third signal indicative of a temperature of the mixture at the outlet of the cooler, determine a relative amount of the refrigerant in the mixture based on the first signal and the second signal, determine a viscosity value of the mixture based on the third signal, output a first control signal in response to the relative amount of the refrigerant in the mixture exceeding a first threshold value, and output a second control signal in response to the viscosity value exceeding a first threshold range.

DRAWINGS

DETAILED DESCRIPTION

Figure 1:
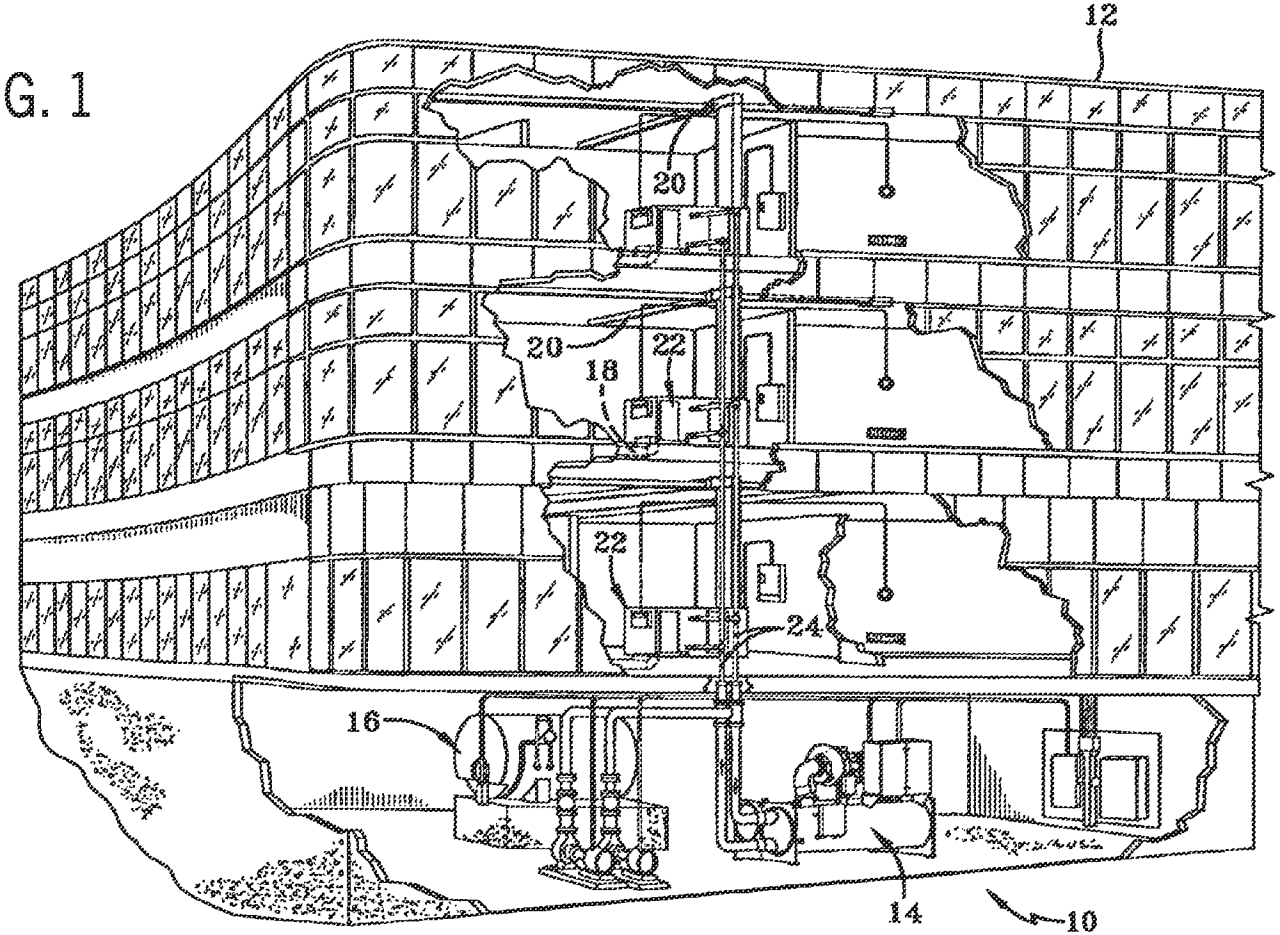
FIG. 1 is a perspective view of a building that may utilize an embodiment of a heating, ventilation, and air conditioning (HVAC) system in a commercial setting, in accordance with an aspect of the present disclosure.

As discussed above, a vapor compression system generally includes a refrigerant flowing through a refrigeration circuit. The refrigerant flows through multiple conduits and components disposed along the refrigeration circuit, while undergoing phase changes to enable the vapor compression system to condition an interior space of a structure. The vapor compression system generally includes a lubrication circuit (e.g., an oil circuit) flowing through certain components of the refrigeration circuit (e.g., a compressor, a sump, and a cooler) to provide lubrication for a compressor of the refrigeration circuit during operation. As lubricant flows through the lubrication circuit, the lubricant may mix with the refrigerant to form a diluted lubricant mixture (e.g., lubricant diluted with refrigerant). Generally, the amount of refrigerant relative to the amount of lubricant in the diluted lubricant mixture (e.g., a dilution value) increases as the temperature of the diluted lubricant mixture increases (e.g., as the temperature within the sump increases) because more refrigerant may dissolve in the lubricant as temperature increases. The diluted lubricant mixture may reduce an operational efficiency of the vapor compression system as the dilution of refrigerant increases. For example, the mixture may not properly lubricate certain components of the compressor if the dilution value exceeds a threshold value. Additionally, as the lubricant flows from the sump and a cooler to the compressor, the lubricant may include properties that reduce the operational efficiency of the vapor compression system. For example, if the lubricant or the diluted lubricant mixture includes a viscosity that exceeds a threshold range upon entering the compressor, the diluted lubricant mixture may inhibit movement of components of the compressor, may not properly lubricate the components of the compressor, and/or may reduce the efficiency of the compressor. If the viscosity of the mixture is relatively low, lubrication of the compressor may be inadequate. If the viscosity of the mixture is relatively high, frictional losses may increase, thereby reducing an efficiency of the vapor compression system. As should be understood, the viscosity may depend on a temperature of the diluted lubricant mixture.

Some examples of fluids that may be used as refrigerants in embodiments of the vapor compression system of the present disclosure are hydrofluorocarbon (HFC) based refrigerants, such as R-410A, R-407, or R-134a, hydrofluoroolefin (HFO) based refrigerants, such as R-1233 or R-1234, "natural" refrigerants, such as ammonia ($NH_3$), R-717, carbon dioxide ($CO_2$), R-744, or hydrocarbon based refrigerants, water vapor, or any other suitable refrigerant. In some embodiments, the vapor compression system may be configured to efficiently utilize refrigerants having a normal boiling point of about 19 degrees Celsius (66 degrees Fahrenheit) at one atmosphere of pressure, also referred to as low pressure refrigerants, as compared to a medium pressure refrigerant, such as R-134a. As used herein, "normal boiling point" may refer to a boiling point temperature measured at one atmosphere of pressure. Some examples of fluids that may be used as lubricants in embodiments of the vapor compression system of the present disclosure are synthetic oils, mineral oils, or any other suitable lubricant.

The present disclosure is directed to control of a vapor compression system based on lubricant dilution and lubricant viscosity. Certain embodiments of the vapor compression system include sensors that detect operating parameters (e.g., temperature and pressure) of the lubricant or the diluted lubricant mixture (e.g., lubricant having refrigerant dissolved therein) at certain locations within the system. For example, the sensors may be disposed within and/or coupled to the sump and may detect the pressure and the temperature of the diluted lubricant mixture within the sump. Based on the pressure and the temperature of the diluted lubricant mixture within the sump, a controller of the vapor compression system may determine or calculate a dilution value of the lubricant in the mixture (e.g., a ratio and/or percentage composition of the refrigerant relative to the lubricant in the mixture). The controller may compare the dilution value (e.g., a relative amount of the refrigerant in the mixture) to a threshold value and output a control signal to perform a control operation based on the dilution value exceeding the threshold value. The relative amount of the refrigerant in the mixture may be a percentage amount of the refrigerant in the mixture relative to a percentage amount of the lubricant in the mixture. In some embodiments, the control operation may include providing a user-detectable alert and/or shutting down the compressor. In other embodiments, the control operation may include adjusting operation of, or shutting down, other components of the vapor compression system to adjust an operating condition of the vapor compression system (e.g., adjusting a temperature of the diluted lubricant mixture within the sump, adjusting a flow rate of the lubricant or of the diluted lubricant mixture from the sump, and/or adjusting a temperature of the lubricant or of the diluted lubricant mixture within the cooler).

During operation of the vapor compression system, the mixture (e.g., diluted lubricant mixture) may exit the sump, flow through a cooler (e.g., a heat exchanger), and into the compressor. The cooler may condition the lubricant to improve an efficiency of the compressor. In certain embodiments, the vapor compression system may include a sensor that detects a temperature of the diluted lubricant mixture at an outlet of the cooler. Based on the temperature at the cooler outlet, the controller may determine a viscosity value of the mixture. The controller may compare the viscosity value to a threshold range and output a control signal to perform a control operation based on the viscosity value exceeding the threshold range. In some embodiments, the control operation may include providing a user-detectable alert and/or shutting down the compressor. In other embodiments, the control operation may include adjusting operation of, or shutting down, other components of the vapor compression system to adjust an operating condition of the vapor compression system (e.g., adjusting a temperature of the diluted lubricant mixture within the sump, adjusting a flow rate of the lubricant or of the diluted lubricant mixture from the sump, and/or adjusting a temperature of the lubricant or of the diluted lubricant mixture within the cooler). As such, based on the dilution value of the diluted lubricant mixture and/or based on the viscosity value of the diluted lubricant mixture, the controller may alert an operator that the dilution value and/or the viscosity value have exceeded the threshold level/range and/or may shutdown the compressor to prevent inefficient operation of the compressor and/or the vapor compression system.

The control techniques of the present disclosure may be used in a variety of systems. However, to facilitate discussion, examples of systems that may incorporate the control techniques of the present disclosure are depicted in FIGS. 1-4, which are described herein below.

Turning now to the drawings, FIG. 1 is a perspective view of an embodiment of an environment for a heating, ventilation, and air conditioning (HVAC) system 10 in a building 12 for a typical commercial setting. The HVAC system 10 may include a vapor compression system 14 that supplies a chilled liquid, which may be used to cool the building 12. The HVAC system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC system 10. The HVAC system 10 is shown with a separate air handler on each floor of building 12, but in other embodiments, the HVAC system 10 may include air handlers 22 and/or other components that may be shared between or among floors.

Figure 2:
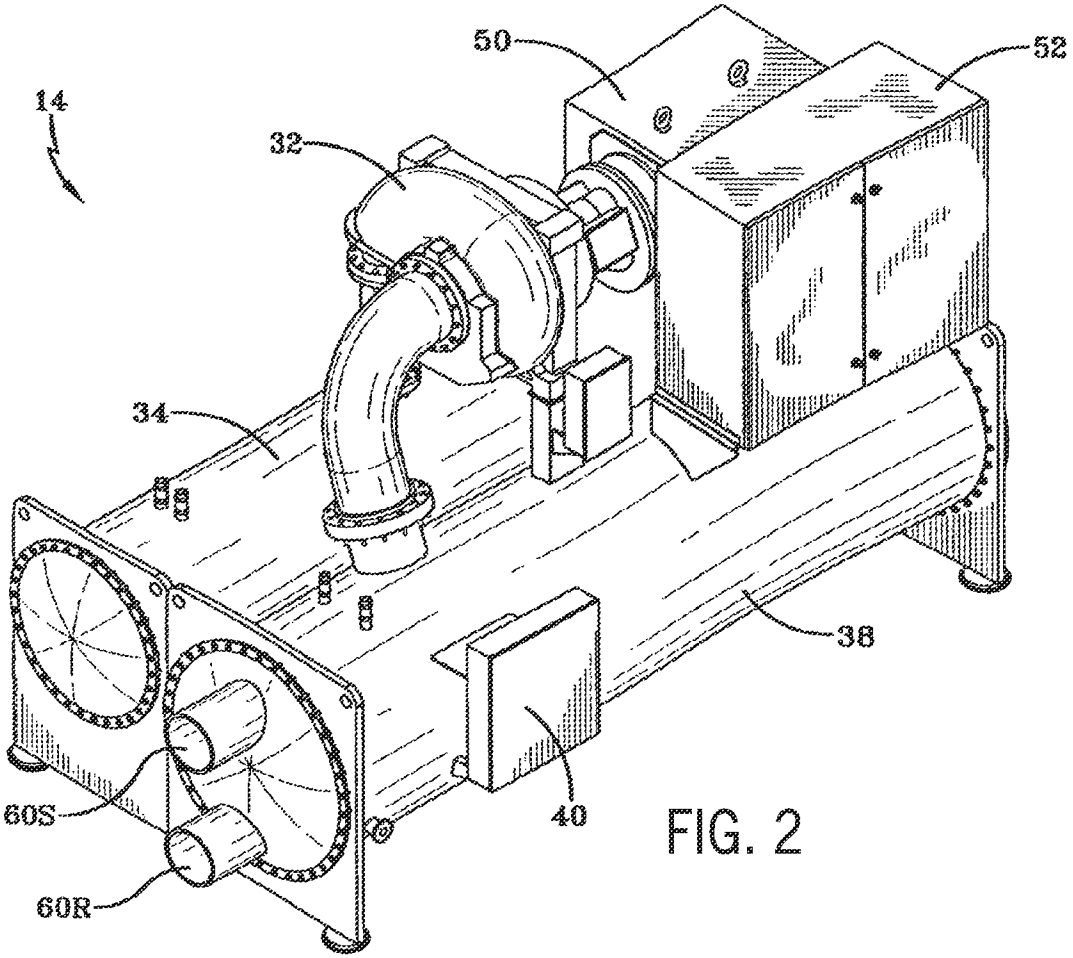
FIG. 2 is a perspective view of an embodiment of a vapor compression system, in accordance with an aspect of the present disclosure.
Figure 3:
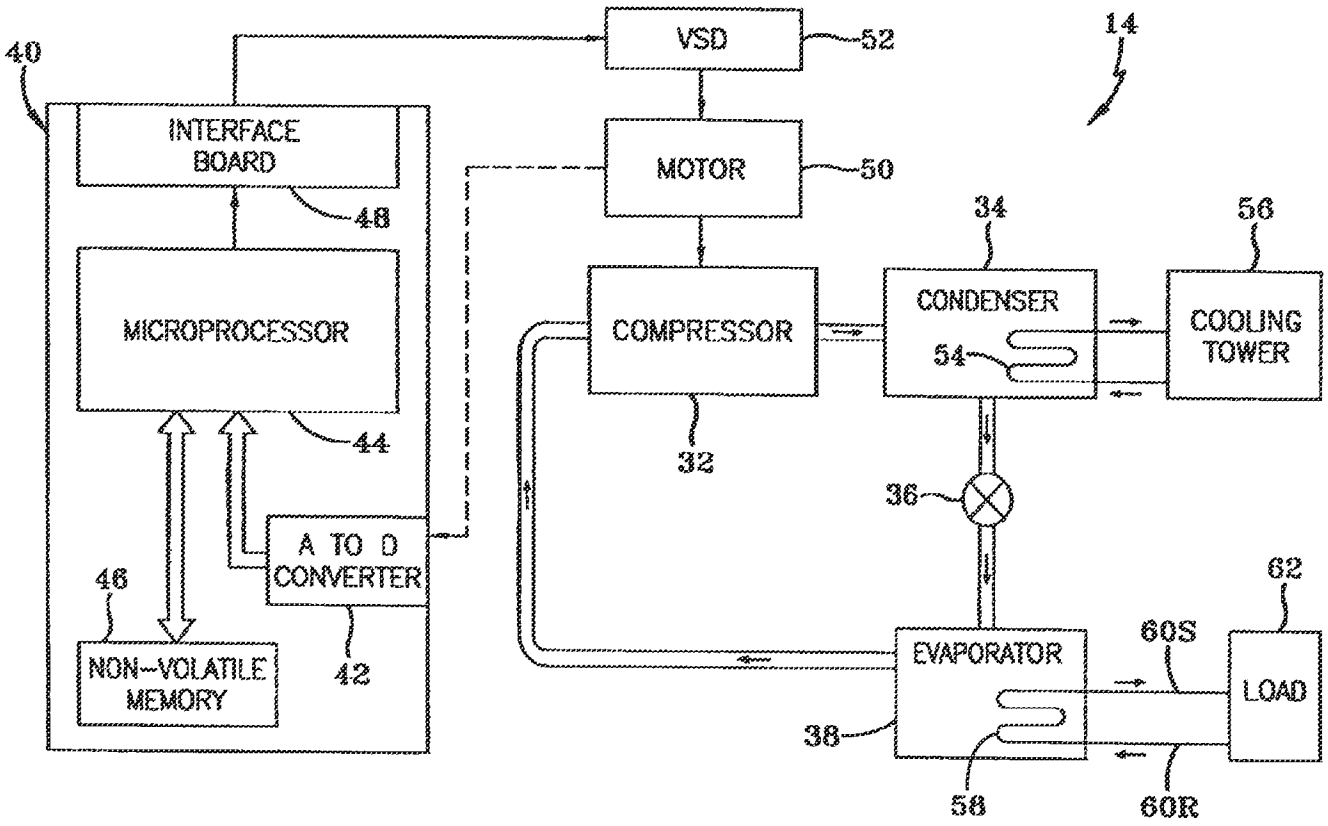
FIG. 3 is a schematic diagram of an embodiment of the vapor compression system, in accordance with an aspect of the present disclosure.

FIGS. 2 and 3 illustrate embodiments of the vapor compression system 14 that can be used in the HVAC system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., controller) that has an analog to digital (A/D) converter 42, a microprocessor 44, a non-volatile memory 46, and/or an interface board 48.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The compressor 32 includes a lubricant (e.g., oil) that lubricates components of the compressor. As described in greater detail below, a portion of the refrigerant within the compressor 32 may mix with the lubricant. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The refrigerant liquid delivered to the evaporator 38 may absorb heat from another cooling fluid, which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

Figure 4:
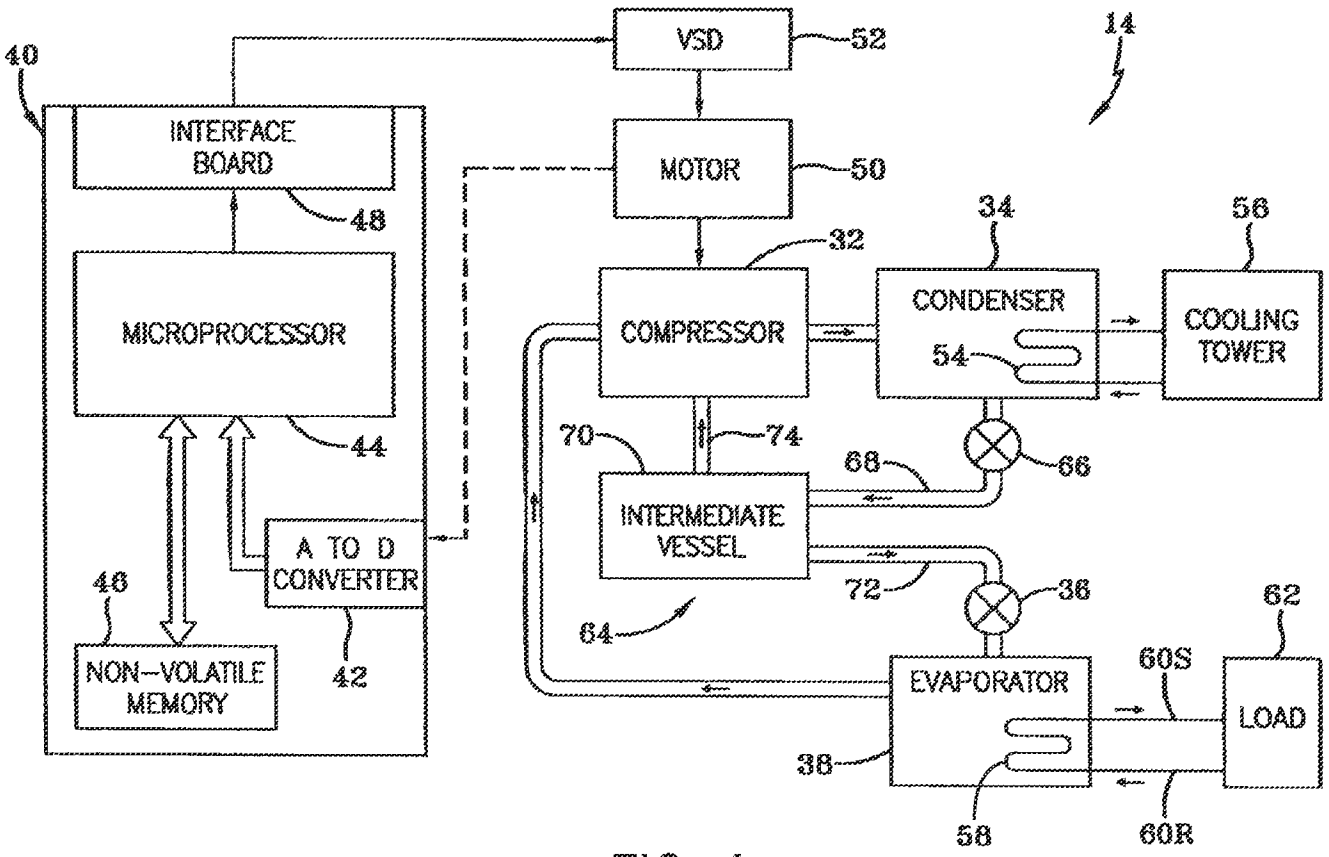
FIG. 4 is a schematic diagram of another embodiment of the vapor compression system, in accordance with an aspect of the present disclosure.

FIG. 4 is a schematic diagram of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the refrigerant liquid received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the refrigerant liquid because of a pressure drop experienced by the refrigerant liquid when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the refrigerant liquid exiting the condenser 34 because of the expansion in the expansion device 66 and/or the intermediate vessel 70. The liquid from intermediate vessel 70 may then flow in line 72 through a second expansion device 36 to the evaporator 38.

Figure 5:
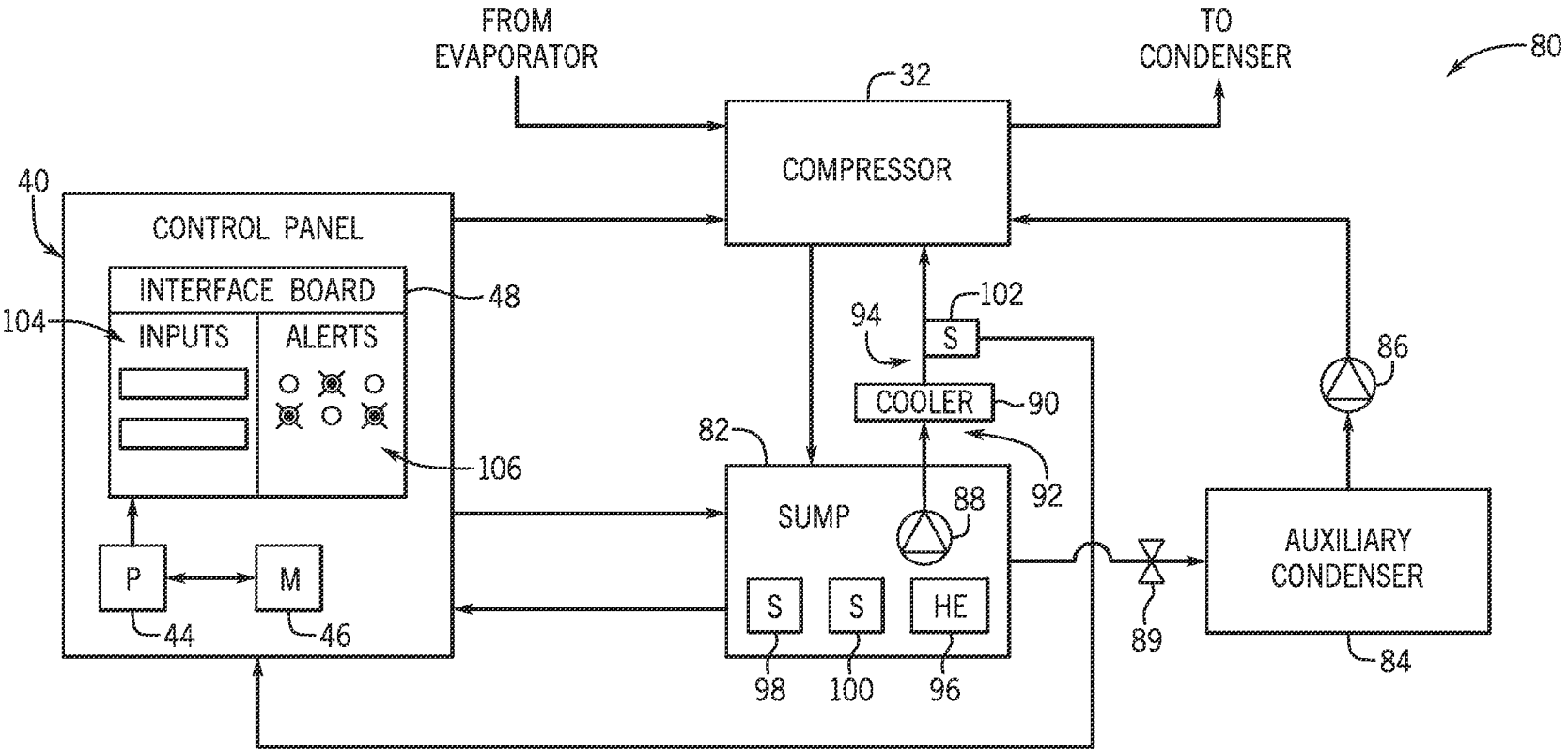
FIG. 5 is a schematic diagram of an embodiment of the vapor compression system having a sump and a cooler coupled to the sump, in accordance with an aspect of the present disclosure.

FIG. 5 is a schematic diagram illustrating an embodiment of a lubrication circuit 80 (e.g., a portion of the vapor compression system 14) that may include one or more components controlled by the microprocessor 44 of the control panel 40 to enhance an efficiency of the vapor compression system 14. As described above, the vapor compression system 14 includes a lubricant (e.g., oil) that circulates through the compressor 32 to lubricate components (e.g., bearings) of the compressor 32. During operation, refrigerant may dissolve or otherwise mix with the lubricant within the compressor 32 to form a mixture of lubricant and refrigerant. For example, the refrigerant and the lubricant may mix with one another as the compressor 32 receives the refrigerant from the evaporator 38, as the refrigerant circulates within the compressor 32, and/or as the refrigerant flows out of the compressor 32 and to the condenser 34.

The lubrication circuit 80 includes a sump 82 fluidly coupled to the compressor 32. After lubricating components of the compressor 32, the mixture of lubricant and refrigerant flows toward and may accumulate within the sump 82. In some embodiments, the composition of the mixture received by the sump 82 may be between approximately (e.g., within 10% of, within 5% of, or within 1% of) 1% and 3% refrigerant by mass and between approximately (e.g., within 10% of, within 5% of, or within 1% of) 97% and 99% lubricant by mass. In other embodiments, the composition of the mixture may be between approximately 3% and 10% refrigerant by mass and between approximately 90% and 97% lubricant by mass, between approximately 5% and 20% refrigerant by mass and between approximately 80% and 95% lubricant by mass, between approximately 10% and 30% refrigerant by mass and between approximately 70% and 90% lubricant by mass, and/or other suitable compositions. As shown in the illustrated embodiment of FIG. 5, the sump 82 is positioned generally below the compressor 32 so that lubricant may flow from the compressor 32 toward the sump 82 via gravity. In certain embodiments, the sump 82 may be positioned at other locations relative to the compressor 32 to receive the lubricant or the mixture of lubricant and refrigerant from the compressor 32.

Within the sump 82, a portion of the refrigerant in the mixture of lubricant and refrigerant may separate from the mixture (e.g., as a refrigerant gas) as the mixture expands upon entering the sump 82. As such, the mixture exiting the sump 82 and returning to the compressor 32 generally contains less refrigerant when compared to the mixture entering the sump 82 and exiting the compressor 32. The refrigerant gas may flow from the sump 82 to an auxiliary condenser 84, which may include a cooling fluid in a heat exchange relationship with the refrigerant gas. The cooling fluid may absorb thermal energy from the refrigerant gas and condense the refrigerant gas to refrigerant liquid. The auxiliary condenser 84 is coupled to a pump 86 that is configured to direct the refrigerant from the auxiliary condenser 84 to the compressor 32 or otherwise back to the vapor compression system 14. Additionally or alternatively, the pump 86 may facilitate the flow of the refrigerant gas from the sump 82 to the auxiliary condenser 84. In certain embodiments, the vapor compression system 14 may include a valve 89 that controls a flow of the refrigerant gas to and from the auxiliary condenser 84. As illustrated, the valve 89 is disposed adjacent to an outlet of the sump 82 and adjacent to an inlet of the auxiliary condenser 84 and, thus, may control the flow of the refrigerant gas to the auxiliary condenser 84. In certain embodiments, the auxiliary condenser 84 may be omitted from the vapor compression system 14 and the lubrication circuit 80 such that the refrigerant gas may be vented to the compressor 32.

After a portion of the refrigerant gas is removed from the mixture, a pump 88 within the sump 82 (e.g., a submersible pump) directs the lubricant or the mixture to a cooler 90. In some embodiments, the pump 88 may be disposed outside the sump 82 and/or may be positioned between the cooler 90 and the compressor 32. The cooler 90 is fluidly coupled to the sump 82 at a cooler inlet 92 and is fluidly coupled to the compressor 32 at a cooler outlet 94. The cooler 90 may be a shell-and-tube heat exchanger or another suitable heat exchanger configured to absorb thermal energy from the mixture flowing from the sump 82 to the compressor 32. For example, the cooler 90 may remove heat from the mixture that is absorbed by the mixture via mechanical friction within the compressor 32. In other words, the cooler 90 may remove heat that is absorbed by the mixture when lubricating the compressor 32. After passing through the cooler 90, the mixture flows to the compressor 32 for lubrication of the components of the compressor 32.

In some embodiments, the sump 82 includes a heating element 96 that provides heat to the mixture within the sump 82 in order to vaporize refrigerant within the mixture and remove the refrigerant from the lubricant. As described in greater detail below, the temperature and the pressure of the mixture within the sump 82 affects the dilution of the mixture. As such, the heating element 96 may be controlled to remove the refrigerant from the mixture, and thus, adjust the dilution of the lubricant that is ultimately directed toward the compressor 32.

Portions of the lubrication circuit 80, and the vapor compression system 14 generally, may be controlled based on feedback indicative of operating parameters of the vapor compression system 14. For example, the vapor compression system 14 may be controlled based on feedback indicative of a temperature and/or a pressure of the mixture within the sump 82, based on feedback indicative of a temperature of the mixture at the cooler outlet 94, and/or based on other feedback. As shown in the illustrated embodiment of FIG. 5, the sump 82 includes a temperature sensor 98 and a pressure sensor 100 configured to provide feedback indicative of the temperature and the pressure of the mixture within the sump 82, respectively. The temperature sensor 98 and the pressure sensor 100 are communicatively coupled to the control panel 40 and are configured to output signals to the control panel 40 indicative of the temperature and the pressure of the mixture within the sump 82. Additionally, the vapor compression system 14 may include a temperature sensor 102 at the cooler outlet 94 that is configured to provide feedback indicative of a temperature of the lubricant and/or the mixture at the cooler outlet 94. The temperature sensor 102 is communicatively coupled to the control panel 40 and is configured to output a signal to the control panel 40 indicative of the temperature at the cooler outlet 94.

Based on the feedback indicative of the temperature and/or the pressure within the sump 82, the microprocessor 44 (e.g., using instructions stored in the memory 46) may determine a dilution (e.g., a dilution value) of the mixture (e.g., a relative amount or percentage composition of the refrigerant relative to the lubricant in the mixture). Additionally or alternatively, the microprocessor 44 may determine a viscosity (e.g., a viscosity value) of the mixture based on the temperature at the outlet of the cooler 90. In other embodiments, the microprocessor 44 may determine the dilution and/or the viscosity of the mixture based on other operating parameters (e.g., a pressure of the mixture in the cooler 90, properties of the refrigerant, and/or properties of the lubricant).

The microprocessor 44 may compare the dilution and/or the viscosity of the mixture to threshold values and/or threshold ranges (e.g., dilution threshold values and viscosity threshold ranges stored in the memory 46). The threshold values and/or the threshold ranges may be determined by the microprocessor 44 based on inputs 104 to the interface board 48 (e.g., inputs indicative of properties of the lubricant and/or the refrigerant). For example, the control panel 40 is configured to receive the inputs 104 at the control panel 40 indicative of properties of the lubricant, the refrigerant, and/or the mixture. Such properties may include a type of lubricant, a type of refrigerant, and/or other properties of the lubricant and/or of the refrigerant. In some embodiments, the inputs 104 may include an operating mode of the vapor compressor compression 14. Alternatively, the inputs 104 may include threshold values and/or the threshold ranges.

The dilution and the viscosity may each be compared to one or multiple threshold values and/or threshold ranges. Based on the comparison, the microprocessor 44 may output control signals to perform control operations on various components of the vapor compression system 14. For example, the microprocessor 44 may compare the dilution to a first threshold value and a second threshold value and output a control signal to perform first and/or second control operations based on the dilution exceeding the first or second threshold value, respectively. The first threshold value may be based on a target percentage or a relative amount of refrigerant in the mixture and/or a target percentage or a relative amount of lubricant in the mixture. Additionally, the second threshold value may include an additional target percentage or a relative amount of refrigerant in the mixture that is greater than the first threshold value. In some embodiments, when the dilution exceeds the second threshold value, the compressor 32 may be shut down. The first threshold value of the dilution may be 5% refrigerant by mass (e.g., a maximum of 5% refrigerant in the mixture), and the second threshold value may be 10% refrigerant by mass. In other embodiments, the first threshold value may be any value between 0% and 30% refrigerant by mass, and the second threshold value may be any value between 0% and 40% refrigerant by mass, with the second threshold value being greater than the first threshold value.

Further, the microprocessor 44 may compare the viscosity to a first threshold range and a second threshold range and output a control signal to perform third and/or fourth control operations based on the viscosity exceeding the first or second threshold ranges, respectively. For example, each of the first threshold range and the second threshold range may include an upper limit and a lower limit. The viscosity may exceed the first threshold range and/or the second threshold range if the viscosity is greater than the upper limit or less than the lower limit. The viscosity may be within the threshold range (e.g., not exceed the threshold range) if the viscosity is less than or equal to the upper limit and greater than or equal to the lower limit. The threshold ranges of the viscosity may be based on target viscosities of the mixture. In certain embodiments, the first threshold range may be generally within the second threshold range such that the second threshold range is larger than the first threshold range. For example, the first threshold range may be between about 3 centistokes ("cSt") and about 30 cSt, between about 5 cSt and about 28 cSt, between about 10 cSt and about 25 cSt, or between about 15 cSt and about 18 cSt. The second threshold range may be between about 2 cSt and about 34 cSt, between about 4 cSt and about 30 cSt, between about 8 cSt and about 28 cSt, or between about 12 cSt and about 20 cSt. In some embodiments, the first threshold range may be between about 14 cSt to about 20 cSt, and the second threshold range may be between about 10 cSt and about 30 cSt.

The microprocessor 44 may output control signals based on the dilution exceeding the first and/or second threshold values, the viscosity exceeding the first and/or second threshold ranges, or both. Such control operations may include providing a user-detectable warning or alert via an indicator 106 of the interface board 48, adjusting a speed or other operational parameter of the compressor 32, shutting down operation of the compressor 32, shutting down operation of other components of the vapor compression system 14 (e.g., the sump 82, the auxiliary condenser 84, or the cooler 90), adjusting the heating element 96 to control the temperature and/or pressure within the sump 82, adjusting a speed of the pump 86, adjusting a speed of the pump 88, adjusting a position of the valve 89 positioned adjacent to the auxiliary condenser 84 to control the flow of the refrigerant gas through the auxiliary condenser 84, other suitable operating parameters, or any combination thereof. The indicator 106 may be any user-detectable notification, such as a light emitting diode (LED), an audible alert, a display, text, and/or another suitable notification. The microprocessor 44 of the control panel 40 may be communicatively coupled to the compressor 32, the sump 82, the auxiliary condenser 84, the pump 86, pump 88, the cooler 90, and/or other components of the vapor compression system 14 to provide such control signals.

By way of a non-limiting example, the microprocessor 44 may output a first control signal to provide a user-detectable notification via the indicator 106 in response to the dilution exceeding the first threshold value. Further, the microprocessor 44 may output a second control signal to shutdown operation of the compressor 32 in response to the dilution exceeding the second threshold value. Additionally or alternatively, the microprocessor 44 may output a third control signal to provide the user-detectable notification via the indicator 106 in response to the viscosity exceeding the first threshold range. Further still, the microprocessor 44 may output a fourth control signal to shutdown operation of the compressor 32 in response to the viscosity exceeding the second threshold range.

Figure 6:
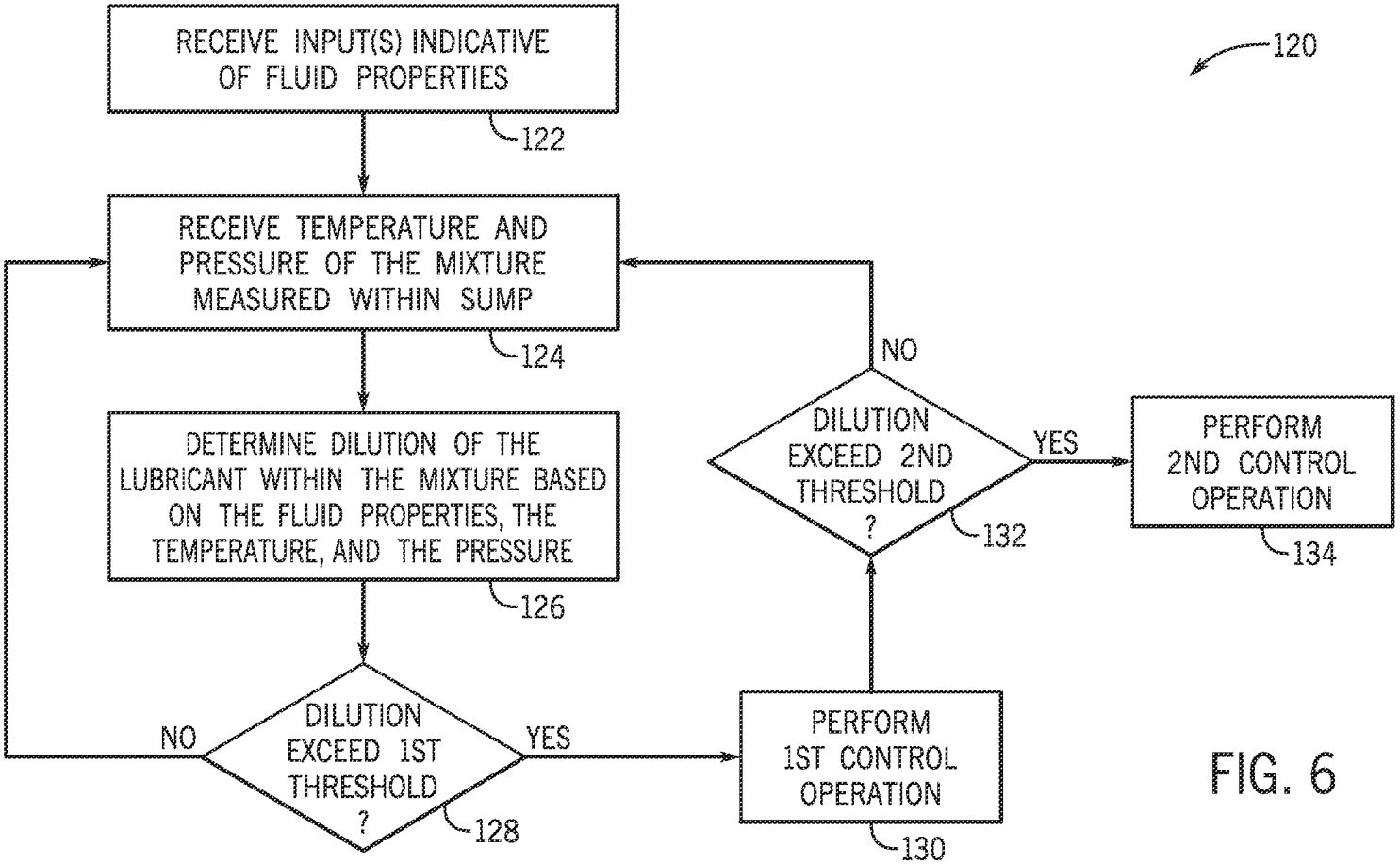
FIG. 6 is a flow chart illustrating an embodiment of a process for operating the vapor compression system, in accordance with an aspect of the present disclosure.

FIG. 6 is a flow chart illustrating an embodiment of a process 120 for operating the vapor compression system 14 and/or the lubrication circuit 80. It is to be understood that the steps discussed herein are merely exemplary, and certain steps may be omitted or performed in a different order than the order described below. In some embodiments, the process 120 may be stored in the memory 46 and executed by the microprocessor 44 of the control panel 40 or stored in other suitable memory and executed by other suitable processing circuitry.

As shown in the illustrated embodiment of FIG. 6, at block 122, the microprocessor 44 receives an input indicative of properties of the lubricant and/or the refrigerant (e.g., operating properties of the lubricant, operating properties of the refrigerant, a type of lubricant, a type of refrigerant, and operating properties of other fluids within the vapor compression system 14). For example, the input may include the inputs 104 provided to the interface board 48. In some embodiments, the input may include the first threshold value and the second threshold value. Alternatively, the microprocessor 44 may determine the first threshold value and the second threshold value based on the input and/or based on information stored in the memory 46.

At block 124, the microprocessor 44 receives feedback indicative of the temperature and/or the pressure of the mixture within the sump 82. For example, the microprocessor 44 may receive a first signal indicative of the temperature from the temperature sensor 98 and a second signal indicative of the pressure from the pressure sensor 100. In some embodiments, the microprocessor 44 may receive feedback indicative of only the temperature or only the pressure of the mixture.

At block 126, the microprocessor 44 determines the dilution of the lubricant based on the input, the feedback indicative of the temperature in the sump 82, and/or the feedback indicative of the pressure in the sump 82. Additionally or alternatively, the microprocessor 44 may reference data (e.g., temperature and pressure tables, fluid property charts, fluid density tables, and/or other suitable data) stored in the memory 46 to determine the dilution of the lubricant. As described above, the dilution is a relative amount of refrigerant within the mixture of refrigerant and lubricant. The relative amount of the refrigerant in the mixture may be a percentage amount of the refrigerant in the mixture relative to a percentage amount of the lubricant in the mixture.

At block 128, the microprocessor 44 determines whether the dilution exceeds a first threshold value. The first threshold value may be received via a user input to the interface board 48 and/or may be determined based on various properties of the refrigerant and lubricant received at block 122. In some embodiments, the first threshold value may be a percentage composition of the lubricant by mass and/or a percentage composition of the refrigerant by mass. The microprocessor 44 compares the dilution determined at block 126 to the first threshold value to determine whether the dilution exceeds the first threshold value. When the dilution exceeds the first threshold value, the process 120 proceeds to block 130. When the dilution does not exceed the first threshold value (e.g., the dilution is less than or equal to the first threshold value), the process 120 returns to block 124. As such, if the dilution does not exceed the first threshold value, the microprocessor 44 may continue to receive feedback indicative of the temperature and/or pressure in the sump 82 (e.g., block 124) to determine the dilution of the mixture (e.g., block 126).

At block 130, the microprocessor 44 performs a first control operation in response to the dilution exceeding the first threshold value. For example, the microprocessor 44 may output a first control signal to adjust an operating condition of a component of the vapor compression system 14 (e.g., adjusting a speed of the pump 86 and/or the pump 88, adjusting an amount of heat supplied by the heating element 96, adjusting a speed of the compressor 32, adjusting a flow of cooling fluid to the cooler 90, and/or adjusting another suitable operating condition). Additionally or alternatively, the first control operation may include providing the user-detectable notification via the indicator 106.

At block 132, the microprocessor 44 determines whether the dilution exceeds a second threshold value, greater than the first threshold value. The second threshold value may be received via a user input to the interface board 48 and/or may be determined based on various properties of the lubricant and/or the refrigerant. In some embodiments, the second threshold value may be a percentage composition of the refrigerant by mass and/or a percentage composition of the lubricant by mass. The microprocessor 44 compares the dilution to the second threshold value to determine whether the dilution exceeds the second threshold value. When the dilution exceeds the second threshold value, the process 120 proceeds to block 134. When the dilution does not exceed the second threshold value (e.g., the dilution is less than or equal to the second threshold value), the process 120 returns to block 124. As such, if the dilution does not exceed the second threshold value, the microprocessor 44 may continue to receive feedback indicative of temperature and/or the pressure in the sump 82 (e.g., block 124) and to determine the dilution of the mixture (e.g., block 126).

At block 134, the microprocessor 44 may perform a second control operation in response to the dilution exceeding the second threshold value. For example, the microprocessor 44 may output a second control signal indicative of instructions to perform a second control operation to a component of the vapor compression system 14 (e.g., shutting down and/or adjusting the operation of the compressor 32, adjusting a speed the pump 86 and/or the pump 88, adjusting an amount of heat supplied by the heating element 96, a flow rate of the cooling fluid through the cooler 90, and/or adjusting another operating parameter). In some embodiments, the second control operation may include providing a second user-detectable notification via the indicator 106 (e.g., a notification different from the notification provided at block 130).

It should be noted that, in some embodiments, blocks 128 and 132 may be performed substantially simultaneously with one another. As such, when the microprocessor 44 determines that the dilution exceeds the second threshold value, the microprocessor 44 may skip block 130 and proceed directly to block 134 to perform the second control operation.

Figure 7:
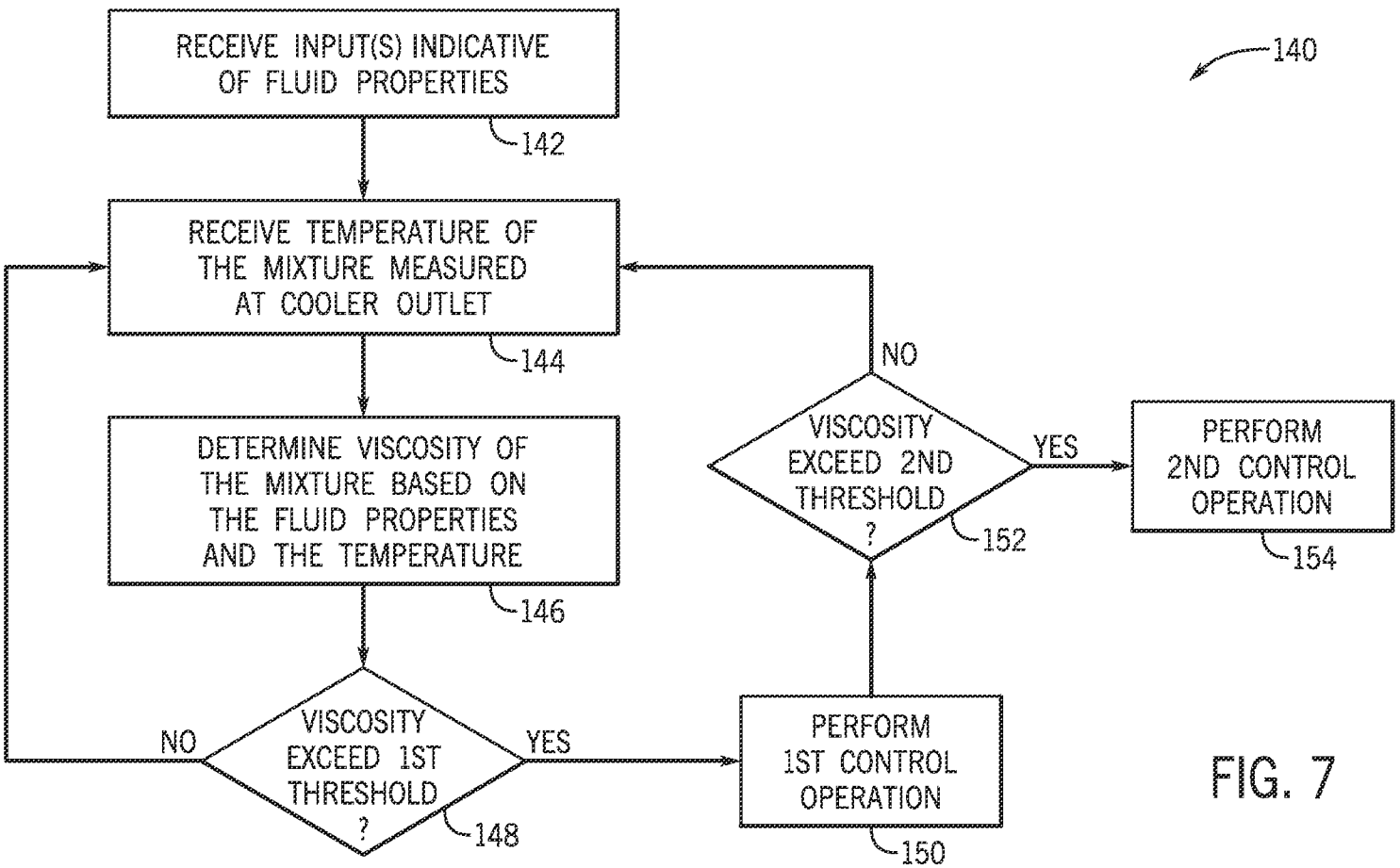
FIG. 7 is a flow chart illustrating an embodiment of a process for operating the vapor compression system, in accordance with an aspect of the present disclosure.

FIG. 7 is a flow chart illustrating an embodiment of a process 140 for operating the vapor compression system 14 and/or the lubrication circuit 80. It is to be understood that the steps discussed herein are merely exemplary, and certain steps may be omitted or performed in a different order than the order described below. In some embodiments, the process 140 may be stored in the memory 46 and executed by the microprocessor 44 of the control panel 40 or stored in other suitable memory and executed by other suitable processing circuitry.

As shown in the illustrated embodiment of FIG. 7, at block 142, the microprocessor 44 receives an input indicative of properties of the lubricant and/or of the refrigerant (e.g., operating properties of the lubricant, operating properties of the refrigerant, a type of lubricant, a type of refrigerant, and operating properties of other fluids within the vapor compression system 14). For example, the input may include the inputs 104 provided to the interface board 48. In some embodiments, the input may include the first threshold range and the second threshold range. Alternatively, the microprocessor 44 may determine the first threshold range and the second threshold range based on the input and/or based on information stored in the memory 46.

At block 144, the microprocessor 44 receives feedback indicative of the temperature of the mixture at the cooler outlet 94. For example, the microprocessor 44 may receive a signal indicative of the temperature from the temperature sensor 102 at the cooler outlet 94.

At block 146, the microprocessor 44 determines the viscosity of the mixture based on the input and/or the feedback indicative of the temperature at the cooler outlet 94 and/or based on the oil dilution determined during the process 120. Additionally or alternatively, the microprocessor 44 may reference data (e.g., temperature tables, fluid property charts, fluid density tables, and/or other suitable data) stored in the memory 46 to determine the viscosity of the mixture. As described above, the viscosity of the mixture corresponds to a thickness of the mixture and the ability of the mixture to flow through the vapor compression system 14 (e.g., through the sump 82 and the compressor 32).

At block 148, the microprocessor 44 determines whether the viscosity exceeds a first threshold range. The first threshold range may be received via a user input to the interface board 48 and/or may be determined based on various properties of the refrigerant and lubricant received at block 142. In some embodiments, the first threshold range may be a particular range viscosities of the mixture. The microprocessor 44 compares the viscosity determined at block 146 to the first threshold range to determine whether the viscosity exceeds the first threshold range (e.g., to determine whether the viscosity is greater than an upper limit of the first threshold range or less than a lower limit of the first threshold range). When the viscosity exceeds the first threshold range, the process 140 proceeds to block 150. When the viscosity does not exceed the first threshold range (e.g., when the viscosity is less than or equal to the upper limit of the first threshold range or greater than or equal to the lower limit of the first threshold range), the process 140 returns to block 144. As such, if the viscosity does not exceed the first threshold range, the microprocessor 44 may continue to receive feedback indicative of the temperature measurement at the cooler outlet 94 (e.g., block 144) to determine the viscosity of the mixture (e.g., block 146).

At block 150, the microprocessor 44 performs a third control operation in response to the viscosity exceeding the first threshold range (e.g., a first control operation relative to the viscosity). For example, the microprocessor 44 may output a third control signal to adjust an operating condition of a component of the vapor compression system 14 (e.g., adjusting a speed of the pump 86 and/or of the pump 88, adjusting an amount of heat supplied by the heat element 96, adjusting a speed of the compressor 32, adjusting a flow of cooling fluid to the cooler 90, and/or adjusting another suitable operating condition). Additionally or alternatively, the third control operation may include providing the user-detectable notification via the indicator 106.

At block 152, the microprocessor 44 determines whether the viscosity exceeds a second threshold range, larger than the first threshold range. The second threshold range may be received via a user input to the interface board 48 and/or may be determined based on various properties of the lubricant, the refrigerant, and/or the mixture of the lubricant and refrigerant. In some embodiments, the second threshold range may be a particular range of viscosities of the mixture different from the first threshold range. The microprocessor 44 compares the viscosity to the second threshold range to determine whether the viscosity exceeds the second threshold range (e.g., to determine whether the viscosity is greater than an upper limit of the second threshold range or less than a lower limit of the second threshold range). When the viscosity exceeds the second threshold range, the process 140 proceeds to block 154. When the viscosity does not exceed the fourth threshold value (e.g., when the viscosity is less than or equal to the upper limit of the second threshold range or greater than or equal to the lower limit of the second threshold range), the process 140 returns to block 144. As such, if the viscosity does not exceed the second threshold range, the microprocessor 44 may continue to receive feedback indicative of the temperature at the cooler outlet 94 (e.g., block 144) and to determine the viscosity of the mixture (e.g., block 146).

At block 154, the microprocessor 44 may perform a fourth control operation in response to the viscosity exceeding the second threshold value. For example, the microprocessor 44 may output a fourth control signal indicative of instructions to perform a fourth control operation to a component of the vapor compression system 14 (e.g., shutting down and/or adjusting the operation of the compressor 32, adjusting a speed of the pump 86 and/or of the pump 88, adjusting an amount of heat supplied by the heat element 96, adjusting a flow rate of the cooling fluid through the cooler 90, or adjusting another operating parameter). In some embodiments, the fourth control operation may include providing a second user-detectable notification via the indicator 106 (e.g., a notification different from the notification provided at block 150).

It should be noted that in some embodiments, blocks 148 and 152 may be performed substantially simultaneously with one another. As such, when the microprocessor 44 determines that the viscosity exceeds the second threshold range, the microprocessor 44 may skip block 150 and proceed directly to block 154 to perform the fourth control operation.

Although the processes 120 and 140 are described herein as individual processes, the processes 120 and 140, or certain steps thereof, may be combined into a single process or method. For example, the vapor compression 14 may perform steps of the processes 120 and 140 simultaneously or independently. By way of non-limiting example, the vapor compression system 14, via the microprocessor 44, may determine both the dilution and the viscosity of the mixture, compare the dilution to the first and second threshold values, compare the viscosity to the first and second threshold ranges, and perform certain control operations (e.g., first, second, third, and/or fourth control operations) based on both comparisons. As such, the vapor compression system 14, via the microprocessor 44, may control certain components and/or provide user-detectable notifications based on the determined dilution and/or the determined viscosity of the mixture.

Accordingly, the present disclosure is directed to control of a vapor compression system based on a dilution (e.g., a dilution value) and a viscosity (e.g., a viscosity value) of a mixture of lubricant and refrigerant of a lubrication circuit. The vapor compression system includes sensors that provide feedback indicative of operating parameters (e.g., temperature and pressure) of the mixture at certain locations within the system. For example, the sensors may be disposed within and/or coupled to a sump of the lubrication circuit and may provide feedback indicative of the pressure and the temperature of the mixture within the sump. Based on the pressure and the temperature of the mixture within the sump, the vapor compression system, via a controller, may determine a dilution of the refrigerant in the mixture (e.g., a ratio and/or percentage composition of the refrigerant in the mixture). The controller may compare the dilution to a threshold value and output a control signal to perform a control operation within the vapor compression system based on the dilution exceeding the threshold value. The control operation may include providing a user-detectable notification and/or adjusting a component of the vapor compression system (e.g., shutting down the compressor, adjusting an amount of heat supplied to the mixture within the sump via a heating element, adjusting a flow rate of the mixture from the sump via a pump, and/or adjusting a flow rate of cooling fluid supplied to a cooler of the lubrication circuit).

During operation of the vapor compression system, the mixture may exit the sump, flow through the cooler, and into the compressor. The cooler may condition the lubricant or mixture to have a target temperature, which may improve an efficiency of the compressor. In certain embodiments, the vapor compression system may include a sensor that detects a temperature of the lubricant or the mixture at an outlet of the cooler. Based on the temperature at the cooler outlet, the controller may determine a viscosity of the mixture. The controller may compare the viscosity to a threshold range and output a control signal to perform a control operation within the vapor compression system based on the viscosity exceeding the threshold range. The control operation may include providing a user-detectable notification and/or adjusting a component of the vapor compression system (e.g., shutting down the compressor, adjusting an amount of heat supplied to the mixture within the sump via a heating element, adjusting a flow rate of the lubricant or the mixture from the sump via a pump, and/or adjusting a flow rate of cooling fluid supplied to the cooler). As such, the controller may notify an operator of that the dilution and/or the viscosity have reached a threshold level and/or a threshold range and may shutdown the compressor based on the dilution and/or the viscosity of the mixture. This control scheme may enable the vapor compression system to operate more efficiently by preventing inefficient operation of the compressor.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the disclosed subject matter. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A vapor compression system, comprising:

a compressor configured to circulate a refrigerant through a refrigerant loop;

a sump configured to receive a mixture of lubricant and the refrigerant from the compressor; and a controller comprising a memory and a processor, wherein the processor is configured to:

receive a first signal indicative of a temperature of the mixture within the sump;

receive a second signal indicative of a pressure of the mixture within the sump;

determine a relative amount of the refrigerant in the mixture based on the first signal and the second signal;

compare the relative amount to a threshold relative amount of the refrigerant in the mixture; and output a control signal in response to the relative amount of the refrigerant in the mixture exceeding the threshold relative amount.

2. The vapor compression system of claim 1, wherein the control signal comprises instructions to display a user-detectable notification.

3. The vapor compression system of claim 1, wherein the threshold relative amount comprises ten percent of the refrigerant in the mixture by mass.

4. The vapor compression system of claim 1, wherein the threshold relative amount comprises a first threshold relative amount, and wherein the processor is configured to output an additional control signal comprising instructions to shutdown the compressor in response to the relative amount of the refrigerant in the mixture exceeding a second threshold relative amount, greater than the first threshold relative amount.

5. The vapor compression system of claim 4, wherein the second threshold relative amount comprises twenty percent of the refrigerant in the mixture by mass.

6. The vapor compression system of claim 4, wherein the processor is configured to determine the first threshold relative amount and the second threshold relative amount based on properties of the lubricant and properties of the refrigerant.

7. The vapor compression system of claim 1, comprising a heating element disposed within the sump and configured to transfer thermal energy to the mixture in the sump, wherein the control signal is output to the heating element.

8. The vapor compression system of claim 1, comprising an auxiliary condenser configured to transfer thermal energy from the refrigerant flowing from the sump to a cooling fluid, wherein the control signal is output to the auxiliary condenser.

9. A vapor compression system, comprising:

a compressor configured to circulate a refrigerant through a refrigerant loop;

a lubrication circuit comprising a cooler configured to receive a mixture of a lubricant and the refrigerant from a sump, wherein the cooler is configured to absorb thermal energy from the mixture received from the sump, and wherein the cooler comprises an inlet fluidly coupled to the sump and an outlet fluidly coupled to the compressor; and a controller comprising a memory and a processor, wherein the processor is configured to:

receive a signal indicative of a temperature of the mixture at the outlet of the cooler;

receive inputs indicative of properties of the lubricant, properties of the refrigerant, or both;

determine a viscosity value of the mixture based on the signal;

determine a threshold range based on the properties of the lubricant, the properties of the refrigerant, or both; and output a control signal in response to the viscosity value exceeding the threshold range.

10. The vapor compression system of claim 9, wherein the control signal comprises a user-detectable notification.

11. The vapor compression system of claim 9, wherein the threshold range comprises a first threshold range, and wherein the processor is configured to output an additional control signal in response to the viscosity value exceeding a second threshold range, larger than the first threshold range.

12. The vapor compression system of claim 11, wherein the additional control signal comprises instructions to shutdown the compressor.

13. The vapor compression system of claim 11, comprising a pump configured to adjust a flow rate of the mixture directed from the cooler to the compressor, wherein the additional control signal is output to the pump, and wherein the additional control signal comprises instructions to adjust the flow rate of the mixture.

14. A vapor compression system, comprising:

a compressor configured to circulate a refrigerant through a refrigerant loop;

a sump configured to receive a mixture of lubricant and the refrigerant from the compressor;

a cooler configured to receive the mixture from the sump, wherein the cooler is configured to absorb thermal energy from the mixture, and wherein the cooler comprises an inlet fluidly coupled to the sump and an outlet fluidly coupled to the compressor; and a controller comprising a memory and a processor, wherein the processor is configured to:

receive a first signal indicative of a temperature of the mixture within the sump;

receive a second signal indicative of a pressure of the mixture within the sump;

receive a third signal indicative of a temperature of the mixture at the outlet of the cooler;

determine a relative amount of the refrigerant in the mixture based on the first signal and the second signal;

determine a viscosity value of the mixture based on the third signal;

output a first control signal in response to the relative amount of the refrigerant in the mixture exceeding a first threshold value; and output a second control signal in response to the viscosity value exceeding a first threshold range.

15. The vapor compression system of claim 14, comprising a heating element disposed within the sump and configured to transfer thermal energy to the mixture in the sump, wherein the first control signal, the second control signal, or both are output to the heating element.

16. The vapor compression system of claim 14, wherein the processor is configured to output a third control signal comprising instructions to shutdown the compressor in response to the relative amount of the refrigerant in the mixture exceeding a second threshold value, greater than the first threshold value.

17. The vapor compression system of claim 16, wherein the processor is configured to output a fourth control signal comprising instructions to shutdown the compressor in response to the viscosity value exceeding a second threshold range, larger than the second threshold range.

18. The vapor compression system of claim 14, wherein the processor is configured to determine the first threshold value and the first threshold range based on a first input indicative of a type of the lubricant, a second input indicative of a type of the refrigerant, or both.

* * * * *